United States Patent [19]

Mitsumoto et al.

[11] 4,208,254

[45] Jun. 17, 1980

[54] METHOD OF PLATING AN IRON-COBALT ALLOY ON A SUBSTRATE

[76] Inventors: Norio Mitsumoto; Satoshi Ichioka; Shinjiro Takeuchi, all of No. 3583, Shimo-Sasame, Toda City, Saitama Prefecture, Japan

[21] Appl. No.: 929,988

[22] Filed: Aug. 1, 1978

Related U.S. Application Data

[63] Continuation-in-part of Ser. No. 781,463, Mar. 25, 1977, abandoned.

[30] Foreign Application Priority Data

| | | | |
|---|---|---|---|
| Sep. 22, 1976 | [JP] | Japan | 51-114203 |
| Oct. 6, 1976 | [JP] | Japan | 51-120046 |
| Nov. 24, 1976 | [JP] | Japan | 51-140946 |

[51] Int. Cl.[2] ..... C25D 3/56

[52] U.S. Cl. ..... 204/43 T; 204/DIG. 9

[58] Field of Search ..... 204/43 T, 43 N, 43 P, 204/123, DIG. 9, 37 R; 75/123 K; 148/121, 31.55

[56] References Cited

U.S. PATENT DOCUMENTS

| | | | |
|---|---|---|---|
| 1,739,752 | 12/1929 | Elmen | 148/121 X |
| 1,839,344 | 1/1932 | Scott | 148/121 |
| 2,619,454 | 11/1952 | Zapponi | 204/43 T |
| 2,937,351 | 5/1960 | Craig | 204/43 T X |
| 3,843,424 | 10/1974 | Thornburg et al. | 75/123 K X |
| 3,868,278 | 2/1975 | Foster et al. | 148/121 X |
| 3,892,604 | 7/1975 | Thornburg et al. | 148/121 X |
| 3,977,919 | 8/1976 | Foster et al. | 148/121 |
| 4,036,709 | 7/1977 | Harbulak | 204/43 T |

FOREIGN PATENT DOCUMENTS

| | | | |
|---|---|---|---|
| 879995 | 6/1953 | Fed. Rep. of Germany | 148/121 |

OTHER PUBLICATIONS

Abner Brenner, "Electrodeposition of Alloys", vol. I, p. 63, (1963).

F. R. Morral, Plating, pp. 693–701, Jun. 1967.

*Primary Examiner*—G. L. Kaplan

*Attorney, Agent, or Firm*—Wenderoth, Lind & Ponack

[57] ABSTRACT

A method of plating an iron-cobalt alloy on a substrate is disclosed. The iron-cobalt alloy having a composition of 7.5–55% of iron and 92.5–45% of cobalt is plated by using a plating bath containing any one of fluoride, borofluoride, silicofluoride and acidic fluoride or further adding at least one of chloride, sulfate and sulfamate thereto.

9 Claims, 29 Drawing Figures

METHOD OF PLATING AN IRON-COBALT ALLOY ON A SUBSTRATE

CROSS REFERENCE OF THE INVENTION

This application is a continuation-in-part of the copending application Ser. No. 781,463 filed Mar. 25, 1977, now abandoned.

BACKGROUND OF THE INVENTION

The present invention relates to a method of plating an iron-cobalt alloy and more particularly to a method of plating a thin film of an iron-cobalt alloy useful as a material having magnetic properties required for delay element and the like.

Heretofore, 50% Fe-50% Co alloy, 13% Al-87% Fe alloy, pure nickel and the like are metallurgically produced as magnetostriction materials. However, these magnetostriction materials except for the pure nickel have such drawbacks that the workability is poor and it is impossible to manufacture relatively thin sheets, for example, sheets having a thickness of 0.1 mm. Furthermore, the 13% Al-87% Fe alloy has such a drawback that the solderability is poor. On the other hand, the pure nickel has a good workability, but is inferior in the magnetic properties to the Fe-Co alloy, so that it is not necessarily useful as the magnetostriction material.

Moreover, there has been attempted to improve the workability of the Fe-Co alloy aiming at excellent magnetic properties thereof. For instance, there is a method wherein about 2% of vanadium is added to the Fe-Co alloy. By the addition of vanadium the workability can be improved, but the magnetic properties inherent to the Fe-Co alloy are conversely degraded.

Accordingly, it is difficult to produce satisfactory materials capable of using as the magnetostriction material of this type by the metallurgical method. Further, there are not yet developed effective methods for producing said satisfactory magnetostriction material.

While, the method of plating an iron-cobalt alloy is not developed and utilized in general field because the plated film of iron-cobalt alloy itself is not particularly superior in, for example, abrasion resistance, corrosion resistance or appearance such as gloss and the like to the other plated films. At the same time, there is not yet developed an effective plating method with respect to the iron-cobalt alloy plated film.

As the method of plating Fe-Co alloy, for example, there has been practised a method of plating an iron-cobalt alloy in a plating bath composed of cobalt chloride, ferrous chloride and calcium chloride. In this method, however, the bath temperature among the plating conditions is as high as 80°–90° C., so that the evaporation loss of the plating solution becomes large and also iron hydroxide is formed and precipitated during the plating and consequently this plating bath becomes very unstable. If the bath temperature is less than 80° C., the electrodeposition strain is large and the cracks are caused in the plated film, so that it is difficult to produce the thick plating film. From these reasons, this method is not practical.

Furthermore, there is proposed the use of the plating bath composed of cobalt sulfate, ferrous sulfate and sodium acetate in addition to the above described chloride plating bath. However, this sulfate plating bath is also not practical because of the formation of white precipitates.

SUMMARY OF THE INVENTION

It is, therefore, an object of the present invention to solve the above mentioned drawbacks of the prior art and to provide a method of producing an iron-cobalt alloy in any form of a thin film to a thick film having a thickness of more than 1 mm by plating.

Another object of the present invention is to provide a thin film of an iron-cobalt alloy having a high magnetostriction, a high electro-mechanical transformation efficiency, a stability to peripheral magnetic field noise and excellent coercive force and magnetic properties under lower magnetic field.

A further object of the present invention is to provide an optimum plating bath for iron-cobalt alloy plating.

A still further object of the present invention is to maintain the plating bath in a stable state by supplementing each of iron and cobalt ions to the bath.

In the conventional chloride plating bath, the formation and precipitation of iron hydroxide is mainly caused by hydrolysis because the bath temperature is high as 80°–90° C. In order to eliminate this drawback, there should be developed a method of plating at a lower temperature without causing the above mentioned electrodeposition strain. The inventors have made various studies with respect to the method of plating iron-cobalt alloy at a relatively low temperature of less than 50° C., the stability of the plating bath and the improvement of electrodeposition strain, and as a result they have successively developed a method of plating iron-cobalt alloy by using a fluoride, a borofluoride, a silicofluoride or an acidic fluoride, whereby the above drawbacks of the prior art are solved and iron-cobalt alloy plated products useful as a material having magnetic properties required for delay element and the like are obtained.

That is, the present invention provides a method of plating an iron-cobalt alloy on a substrate which comprises plating the iron-cobalt alloy consisting of 7.5–55% by weight of iron and 92.5–45% by weight of cobalt in a plating bath containing any one of fluoride, borofluoride, silicofluoride and acidic fluoride or further adding at least one of chloride, sulfate and sulfamate thereto and having a pH of 0.4–4.0. In a preferred embodiment of the present invention, the plating is carried out by applying an electrolytic current of a modulated wave selected from a wave superimposed direct current upon alternating current, a three-phase limited rectification wave, a distorted wave, an alternating rectification wave by alternating and direct currents and a rectangular wave.

As the fluoride, use may be made of hydrofluoric acid, sodium fluoride, calcium fluoride, potassium fluoride, ammonium fluoride, cobalt fluoride, ferrous fluoride and the like. As the borofluoride, use may be made of cobalt borofluoride, ferrous borofluoride, sodium borofluoride, potassium borofluoride, calcium borofluoride, ammonium borofluoride and the like. As the silicofluoride, use may be made of silicon hydrofluoric acid, sodium silicofluoride, potassium silicofluoride, calcium silicofluoride, ammonium silicofluoride and the like. As the acidic fluoride, use may be made of acidic sodium hydrogen fluoride, acidic potassium hydrogen fluoride, acidic calcium hydrogen fluoride, acidic ammonium hydrogen fluoride and the like.

According to the present invention, the amount of each of the fluoride, borofluoride, silicofluoride and acidic fluoride to be added is within a range of 0.5–200 g/l. When the addition amount is less than 0.5 g/l, the iron hydroxide is considerably formed and floats in the plating bath, so that the plating itself is adversely affected. For instance, the strain of the plated film becomes large, the concentration of iron ion lowers, and the stability of the plating bath is lost. On the other hand, when the addition amount is more than 200 g/l, the current efficiency considerably lowers during the plating. Particularly, when hydrofluoric acid is used in an amount of more than 200 g/l, a large amount of hydrogen gas is generated, the current efficiency extremely lowers and the corrosion of the substrate and other apparatuses is caused.

In the plating bath, pH is adjusted to 0.4–4.0, preferably 1.0–3.0. When pH exceeds 4.0, the alloy composition of the plated film becomes ununiform due to the difference of propagation rate between the plating components and hence the magnetic properties are degraded.

In order to produce an iron-cobalt alloy consisting of 7.5–55% of iron and 92.5–45% of cobalt, iron and cobalts are preferably used within ranges of 5–200 g/l and 50–350 g/l, respectively.

According to the preferred embodiment of the present invention, the plating is carried out by using a plating bath containing any one of fluoride, borofluoride, silicofluoride and acidic fluoride and at least one of chloride, sulfate and sulfamate because the plating bath containing the fluoride, borofluoride, silicofluoride or acidic fluoride alone is about two times higher in the cost than the conventional chloride plating bath. In this case, the plated iron-cobalt alloy can be cheaply produced, for example, by using the chloride, sulfate and/or sulfamate of iron and cobalt.

According to the present invention, the iron-cobalt alloy can be plated on the surface of a substrate even at room temperature without causing the formation of cracks in the plated film because the electrodeposition strain can be more reduced as the concentration of metal ion becomes higher.

Furthermore, a reducing agent such as organic acids, organic amines, inorganic amines or the like (e.g. ascorbic acid, ethyleneamine, hydroxyamine hydrochloride, formalin, etc.) may be added in a proper amount in order to make small the change of $Fe^{++}$ to Fe. Moreover, sodium laurate may be added for decreasing the surface tension of the plating solution or sodium 1, 5-naphthalene disulfonate and the like may be added as a strain decreasing agent.

According to another preferred embodiment of the present invention, the plating is carried out by using an electrolytic current of a modulated wave, whereby the particle size of the crystal to be plated can be made small and the occlusion of hydrogen gas can be decreased and hence the electrodeposition strain can be decreased. Further, by properly selecting the modulated wave from a wave superimposed direct current upon alternating current, a three-phase limited rectification wave, a distorted wave, an alternating rectification wave by alternating and direct currents and a rectangular wave, the plating can be carried out while multi-layering the plated layer of iron-cobalt alloy itself. Thus, the plated product of iron-cobalt alloy having a peculiarity as a magnetostriction material can be obtained.

The formation of such modulated waves will be described with reference to a circuit diagram of FIG. 1.

FIG. 1*a* shows an example of superimposing an alternating current (AC) upon a direct current (DC), wherein symbol E is a DC source, symbol M-1 a DC ammeter, symbol M-2 an AC ammeter, numeral 1 a plating tank and numeral 2 an electrode for plating. The ratio of AC to DC is desirable to be 2–5:1, but the optimum ratio can be selected within the above range in accordance with the composition of the plating bath to be used.

FIGS. 1*b* and 1*c* show circuit diagrams for forming three-phase limited rectification semi-waves (interrupted current waves) corresponding to FIGS. 1*d* and 1*e*, respectively. FIGS. 1*f* and 1*g* show circuit diagrams for forming single-phase and three-phase limited rectification waves as distorted waves corresponding to FIGS. 1*h* and 1*i*, respectively. FIG. 1*j* shows a circuit diagram for forming an alternating rectification wave by AC and DC corresponding to FIG. 1*k*. Further, FIG. 1*l* shows a circuit diagram for forming a rectangular wave corresponding to FIG. 1*m*.

When the iron-cobalt alloy is plated by using the circuit of each of FIGS. 1*a*, 1*b*, 1*c*, 1*f*, 1*g* and 1*j*, a dense plated film having a small internal strain can be obtained. Particularly, when the plating is carried out by using the circuit of FIG. 1*l*, the resulting plated film is layer-like as shown in FIG. 2, so that the homogenization of the alloy composition can be achieved more effectively. For example, in case of usual direct current, there is a difference in the alloy composition between the initial stage and the last stage during the plating, i.e., the alloy composition is 10% of iron and 90% of cobalt at the initial stage and 20% of iron and 80% of cobalt at the last stage, so that the accuracy of the alloy composition is poor in view point of homogenization. On the contrary, in case of FIG. 1*l*, the unbalance of alloy composition can be minimized due to the formation of layer and further the propagation rate of the plating component can be made uniform over the whole surface of the plated film, whereby the smooth surface of the plated film can be obtained independently of the smoothness of the substrate surface, that is, the electropolishing acts at the last stage rather than the initial stage during the plating to smoothen the surface of the plated film.

Up to now, there has not yet been established a countermeasure for maintaining the iron and cobalt ion concentrations and the ratio of these concentrations at constant values in the plating method of iron-cobalt alloy. Generally, in order to maintain the metal ion concentrations and the concentrations ratio in the common plating method at constant values, there have been proposed addition of chemicals, use of alloy anode, use of separated anode and the like. In case of plating iron-cobalt alloy, however, the supplement of chemicals does not give the satisfactory result owing to the properties of the chemical added and is unsuitable. While, when using the alloy anode, the iron-cobalt alloy plate is not commercially available, so that there is a problem relating to the availability of the alloy anode itself. Moreover, when using the separate anode, the plating must be effected in compliance with the current and current efficiency in the separate anode, so that there are technical difficulties.

The inventors have further made various studies with respect to the method of plating the iron-cobalt alloy as mentioned above and as a result, found out that the alloy composition of the plated product depends upon the ratio of iron ion concentration to cobalt ion concentration as seen from FIG. 3 showing a relation between the ratio of iron to cobalt ion concentrations in the plating bath and the alloy composition of the plated product. Further, it has been found out that it is important to always maintain the ratio of iron to cobalt ion concentrations in the plating bath at constant in order to stably deposit the iron-cobalt alloy having a high output voltage as seen from FIG. 4 showing a relation between the alloy composition and the output voltage.

With the foregoing in mind, the inventors have studied a method of always maintaining the ratio of metal ion concentrations in the plating bath for iron-cobalt alloy at constant and found out that only the amount of each of iron and cobalt plated is supplemented by electrical dissolution of each of respective iron and cobalt anodes.

That is, in the plating bath as defined above, iron plate and cobalt plate are arranged as anodes and a given electrolytic current is passed through each plate, whereby each of the iron and cobalt plates is dissolved to supplement the iron and cobalt ions during plating. In practice, as shown in FIGS. 5 and 6, each of iron plate 1 and cobalt plate 2 is dissolved by application of electrolytic current in accordance with the alloy composition of the desired plated product, whereby the iron and cobalt ion concentrations in the plating bath are substantially maintained at constant. In this case, however, the anodic current density varies depending upon the anodic current density and purity of each of the iron and cobalt plates 1 and 2, so that it is necessary that the anodic current density of each plate is measured so as to effect the correction of the current to be applied on each plate. In these drawings, a numeral 4 is a variable resistor and a numeral 5 is a cathode.

Furthermore, the present invention is also concerned with high magnetostriction materials produced by subjecting the iron-cobalt alloy obtained by the above plating method to a heat treatment at a temperature of 400°-750° C.

In general, the magnetostriction material such as delay element and the like require high magnetostriction property, high electro-mechanical transition efficiency, stability against circumferential magnetic noise, a coercive force actuating even with a possibly low excitation power and the like.

As the material of this type, there have been known ferrite (Ni-Cr series alloy), 13% Al-Fe alloy, pure nickel, 2% V-Fe-Co alloy, 50% Fe-Co alloy and the like. However, these materials are inferior in the temperature characteristics, workability, solderability, output voltage and the like, so that when they are used to manufacture the desired electron parts, some of the above mentioned requirements are sacrified and the function of the resulting parts is insufficient.

On the contrary, the plated film of iron-cobalt alloy satisfies the above mentioned requirements as it is. The inventors have found out that when such plated film is subjected to a heat treatment at a temperature of 400°-750° C. for 3 minutes to 4 hours, the properties of the film, particularly output voltage and the like can be considerably improved and as a result, the invention has been accomplished.

That is, in the iron-cobalt alloy just after the plating, an excessive internal stress still remains, so that the magnetic properties of such alloy may not be developed due to the presence of the residual internal stress even by applying a given exciting current. When the alloy is subjected to the heat treatment, the residual internal stress can completely be eliminated.

The invention will now be described with reference to the accompanied drawings.

DETAILED DESCRIPTION OF THE INVENTION

The invention will be described in detail with reference to the following examples.

EXAMPLE 1

| | |
|---|---|
| Plating bath: | |
| Cobalt fluoride | 86.86 g/1 |
| Ferrous fluoride | 13.14 g/1 |
| Plating conditions: | |
| Temperature | 50° C. |
| Current density(cathode) | 5 A/dm$^2$ |
| Plating rate | 0.93 μ/min. (average) |
| Agitation | None |

An iron-cobalt alloy was plated on a stainless steel substrate in the plating bath having the above mentioned composition under the above mentioned plating conditions to obtain a plated film of iron-cobalt alloy consisting of 16% of iron and 84% of cobalt.

Furthermore, when the bath temperature was maintained at 80° C. for 1 hour, there was not observed the precipitation of iron hydroxide. Moreover, when the plating was carried out at the bath temperature of 25° C., cracks were not formed in the plated film.

From the results of this example, it can be seen that the plating bath according to the present invention does not cause the coprecipitation of hydroxide because the generation of hydrogen is small as compared with the case of the conventional chloride plating bath and that the stress caused by excessive energy becomes small because of low applied voltage.

Similar results were obtained by using any one of borofluoride, silicofluoride and acidic fluoride instead of the above mentioned fluoride.

EXAMPLE 2

| | |
|---|---|
| Plating bath: | |
| Cobalt chloride | 175.1 g/l |
| Sodium fluoride | 5 g/l |
| Ferrous chloride | 26.49 g/l |
| Plating conditions: | |
| Temperature | 50° C. |
| Current density (cathode) | 5 A/dm$^2$ |
| Plating rate | 0.93 μ/min. (average) |
| Agitation | None |

An iron-cobalt alloy was plated on a stainless steel substrate in the above plating bath under the above plating conditions to obtain the plated film of iron-cobalt alloy consisting of 15.16% of iron and 84.84% cobalt. The plated film was excellent in the mechanical strength.

Figure 1A:
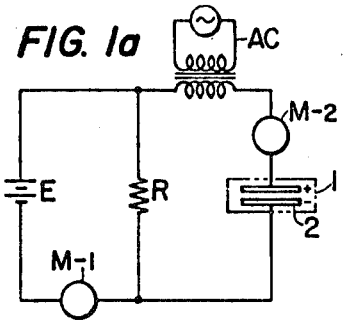
FIGS. 1*a*–1*m* are circuit diagrams and modulation waves produced therefrom used for plating the iron-cobalt alloy according to the present invention, respectively.
Figure 1B:
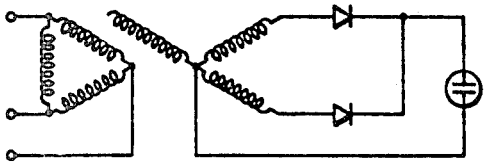
Figure 1C:
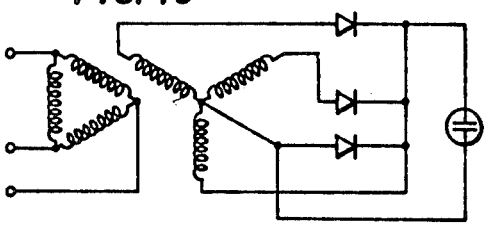
Figure 1D:
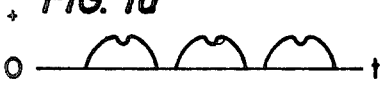
Figure 1E:
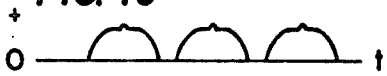
Figure 1F:
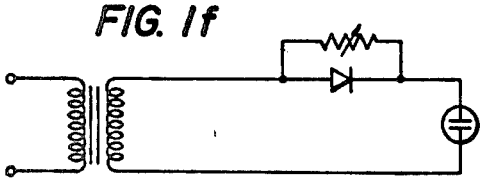
Figure 1G:
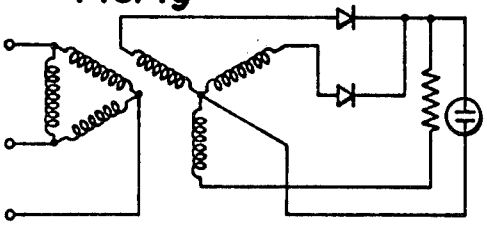
Figure 1H:
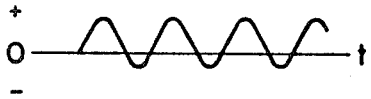
Figure 1I:
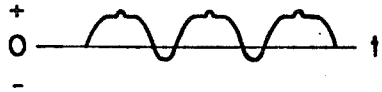
Figure 1J:
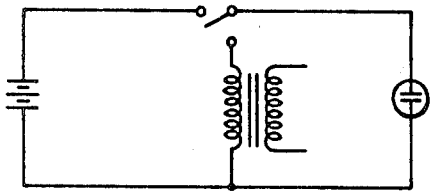
Figure 1K:
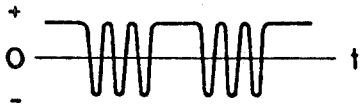
Figure 1L:
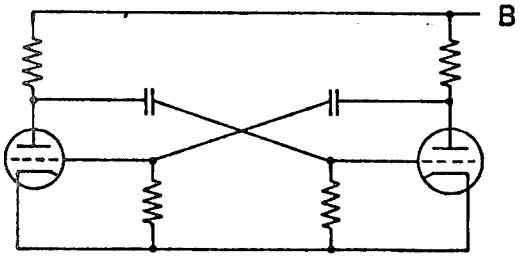
Figure 1M:
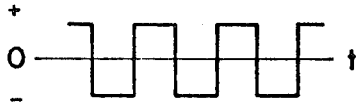
Figure 2:
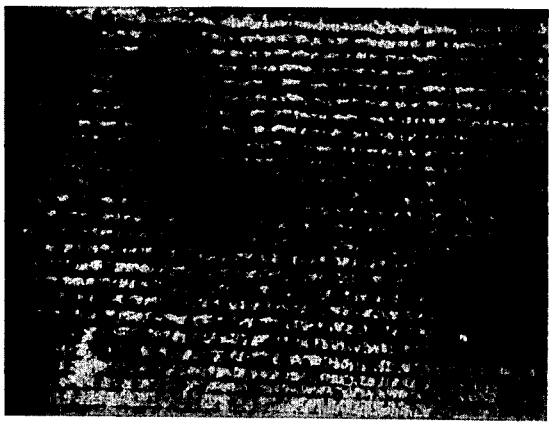
FIG. 2 is a photomicrograph (magnification: 400 times) showing a section of the plated product obtained by using the circuit of FIG. 1*l*.
Figure 3:
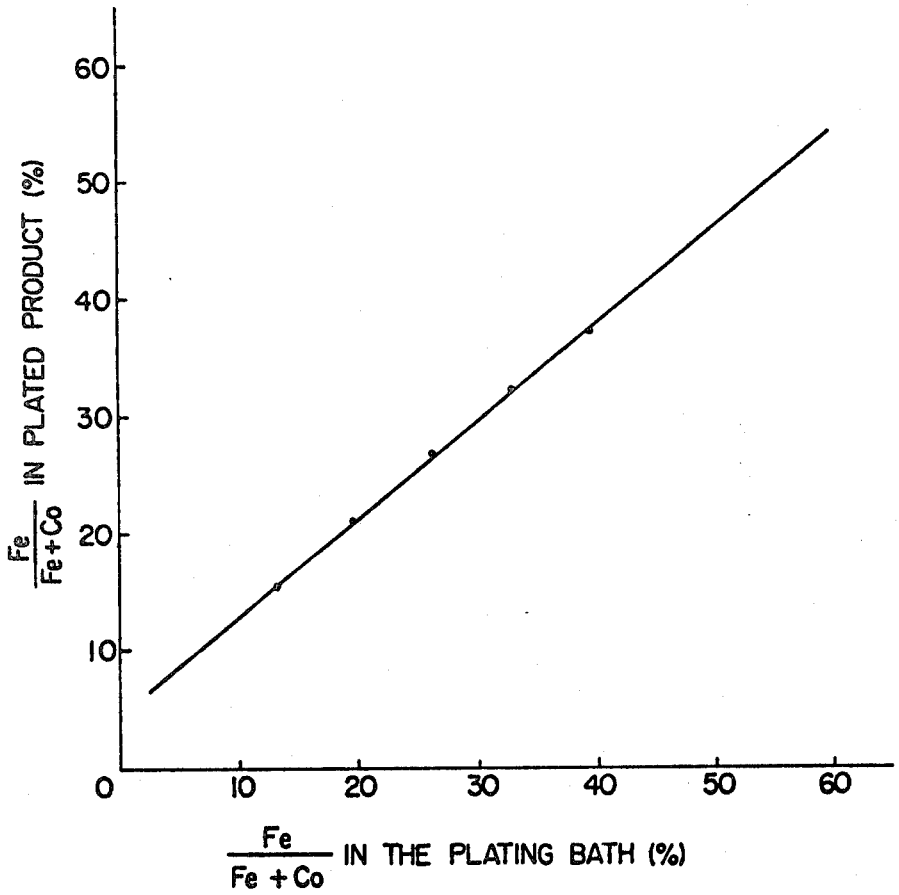
FIG. 3 is a graph showing the composition of the plated Fe-Co alloy by varying cobalt chloride and ferrous chloride as a parameter in the plating bath according to the present invention.
Figure 4:
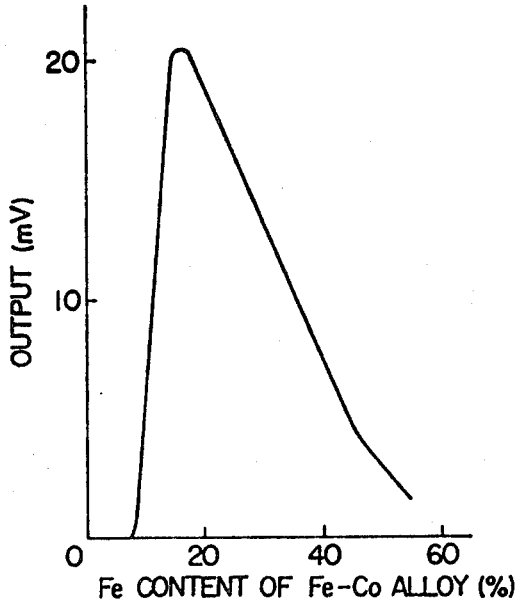
FIG. 4 is a graph showing a relation between the iron content of the Fe-Co alloy and the output voltage.

The composition of the plated iron-cobalt alloy was measured by varying the concentrations of cobalt chloride and ferrous chloride in the above described plating bath as a parameter while maintaining the concentration of sodium fluoride and the total metal ion concentration at 5 g/l and 50 g/l, respectively. The obtained results are shown in FIG. 3. In this figure, the abscissa is the concentration of ferrous ion ($Fe^{++}$) in the plating bath and the ordinate is the content of iron (Fe) in the plated film.

It can be seen from FIG. 3 that the composition of the plated iron-cobalt alloy is substantially proportional to a ratio of iron ion concentration to cobalt ion concentration in the plating bath to be used. Moreover, the degree of such proportion is somewhat different depending upon the kind and concentration of metal salts in the plating bath.

Furthermore, it has been confirmed that the composition of the iron-cobalt alloy does not substantially change when the plating is carried out under the same plating condition as described above except that the current density is varied within a range of 3.5–10 A/dm$^2$.

EXAMPLE 3

| | |
|---|---|
| Plating bath: | |
| Cobalt chloride | 178.1 g/l |
| Ferrous borofluoride (45% aqueous solution) | 20 cc/l |
| Ferrous chloride | 10.11 g/l |
| Plating conditions: | |

-continued

| | |
|---|---|
| Cathode current density | 5 A/dm$^2$ |
| Anode current density | 5 A/dm$^2$ |
| Temperature 50° C. | |

An iron-cobalt alloy was plated on a stainless steel substrate in the plating bath having the above mentioned composition under the above mentioned plating conditions to obtain a plated film of iron-cobalt alloy consisting of 15.16% of iron and 84.84% of cobalt. During plating, each current efficiency was measured, whereby it has been found that the anodic current efficiency of iron is 97.3%, that of cobalt is 97.0% and the cathodic current efficiency is 96.3%. From this result, it can be seen that the current efficiency of iron is 0.3% higher than that of cobalt.

Figure 5:
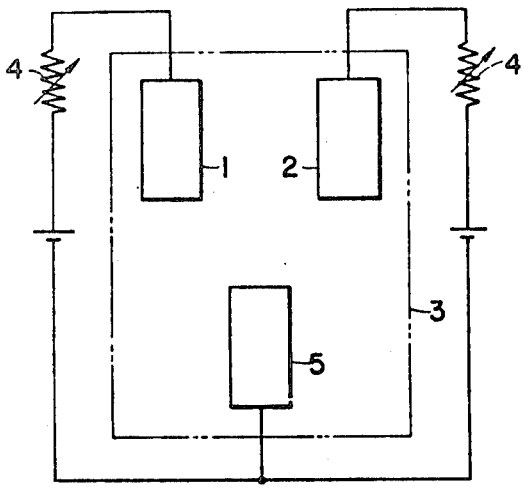
FIGS. 5 and 6 are electric circuits to be used for supplementing the iron and cobalt ion concentrations in the plating bath according to the present invention, respectively.
Figure 6:
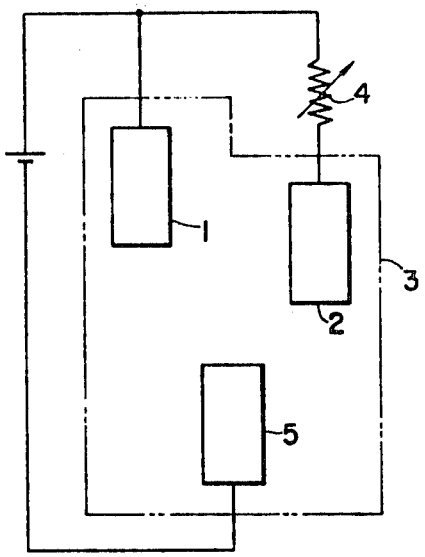

The plating was continuously carried out by using the iron plate 1 and the cobalt plate 2 as anodes in the plating bath 3 as shown in FIG. 5 and applying electrolytic currents of 15.006% and 84.994% (Fe: 1.5006 A, Co: 8.4994 A) which were corrected by the current efficiencies of the plates 1 and 2.

Even if the total amount of iron and cobalt ions in the above plating bath was completely deposited (Fe: 13.14%, Co: 86.86%), the total metal iron concentration of the bath was about 6.5% higher than that prior to the plating, while the ratio of the metal ion concentrations was Fe=13.30%:Co=86.7% and in this case, the concentration of iron ion was only 0.16% larger than that prior to the plating. Further, the plated product had the alloy composition of 15.42% of iron and 84.58% of cobalt. From these results, it can be seen that the plating bath is very stable.

Moreover, it has been confirmed that the increase of the total metal ion concentration in the plating bath is due to the fact that the cathodic current efficiency is smaller than the anodic current efficiency under the above mentioned plating conditions. In order to correct such increase of the total metal ion concentrations, the plating may be stopped or an additional plating may be effected by providing an additional plating bath (not shown) and using an insoluble anode plate (for example, carbon plate).

In the following examples, there are mentioned only the typical compositions of the plating baths useful for practising the present invention.

EXAMPLE 4

| | |
|---|---|
| Cobalt borofluoride (45% aqueous solution) | 200 cc/l |
| Ferrous borofluoride (45% aqueous solution) | 20 cc/l |

EXAMPLE 5

| | |
|---|---|
| Cobalt chloride | 175.1 g/l |
| Ferrous borofluoride (45% aqueous solution) | 20 cc/l |
| Ferrous chloride | 10.11 g/l |

EXAMPLE 6

| | |
|---|---|
| Cobalt chloride | 168 g/l |
| Cobalt borofluoride | 10 g/l |

-continued

| | |
|---|---|
| Ferrous chloride | 19.15 g/l |

EXAMPLE 7

| | |
|---|---|
| Cobalt chloride | 175.1 g/l |
| Ammonium fluoride | 5 g/l |
| Ferrous chloride | 26.49 g/l |

EXAMPLE 8

| | |
|---|---|
| Cobalt chloride | 175.1 g/l |
| Sodium silicofluoride | 5 g/l |
| Ferrous chloride | 26.49 g/l |

EXAMPLE 9

| | |
|---|---|
| Cobalt chloride | 175.1 g/l |
| Acidic sodium hydrogen fluoride | 5 g/l |
| Ferrous chloride | 26.49 g/l |

EXAMPLE 10

| | |
|---|---|
| Cobalt chloride | 168 g/l |
| Cobalt borofluoride | 10 g/l |
| Ferrous sulfate | 32.6 g/l |

EXAMPLE 11

| | |
|---|---|
| Cobalt chloride | 175.1 g/l |
| Ammonium fluoride | 5 g/l |
| Ferrous sulfate | 26.49 g/l |

EXAMPLE 12

| | |
|---|---|
| Cobalt chloride | 175.1 g/l |
| Sodium silicofluoride | 5 g/l |
| Ferrous sulfate | 26.49 g/l |

EXAMPLE 13

| | |
|---|---|
| Cobalt chloride | 175.1 g/l |
| Acidic sodium hydrogen fluoride | 5 g/l |
| Ferrous sulfate | 26.49 g/l |

EXAMPLE 14

| | |
|---|---|
| Cobalt chloride | 168 g/l |
| Cobalt borofluoride | 10 g/l |
| Ferrous sulfamate (12% aqueous solution) | 54.75 cc/l |

EXAMPLE 15

| | |
|---|---|
| Cobalt sulfate | 198.75 g/l |
| Cobalt borofluoride | 10 g/l |
| Ferrous chloride | 19.15 g/l |

EXAMPLE 16

| | |
|---|---|
| Cobalt sulfate | 198.75 g/l |
| Cobalt borofluoride | 10 g/l |
| Ferrous sulfate | 32.6 g/l |

EXAMPLE 17

| | |
|---|---|
| Cobalt sulfate | 198.57 g/l |
| Cobalt borofluoride | 10 g/l |
| Ferrous sulfamate (12% aqueous solution) | 54.75 cc/l |

EXAMPLE 18

| | |
|---|---|
| Cobalt sulfamate (45% aqueous solution) | 347.5 cc/l |
| Cobalt borofluoride | 10 g/l |
| Ferrous chloride | 19.15 g/l |

EXAMPLE 19

| | |
|---|---|
| Cobalt sulfamate (45% aqueous solution) | 347.5 cc/l |
| Cobalt borofluoride | 10 g/l |
| Ferrous sulfate | 32.6 g/l |

EXAMPLE 20

| | |
|---|---|
| Cobalt sulfamate (45% aqueous solution) | 347.5 cc/l |
| Cobalt borofluoride | 10 g/l |
| Ferrous sulfamate (12% aqueous solution) | 54.75 cc/l |

EXAMPLE 21

| | |
|---|---|
| Cobalt chloride | 175.1 g/l |
| Ferrous borofluoride (45% aqueous solution) | 20 cc/l |
| Ferrous sulfate | 17.26 g/l |

EXAMPLE 22

| | |
|---|---|
| Cobalt chloride | 175.1 g/l |
| Ferrous borofluoride (45% aqueous solution) | 20 cc/l |
| Ferrous sulfamate (12% aqueous solution) | 28.91 cc/l |

EXAMPLE 23

| | |
|---|---|
| Cobalt sulfate | 206.8 g/l |
| Ferrous borofluoride (45% aqueous solution) | 20 cc/l |
| Ferrous chloride | 10.1 g/l |

EXAMPLE 24

| | |
|---|---|
| Cobalt sulfate | 206.8 g/l |
| Ferrous borofluoride (45% aqueous solution) | 20 cc/l |
| Ferrous sulfate | 17.26 g/l |

EXAMPLE 25

| | |
|---|---|
| Cobalt sulfate | 206.8 g/l |
| Ferrous borofluoride (45% aqueous solution) | 20 cc/l |
| Ferrous sulfamate (12% aqueous solution) | 28.91 g/l |

EXAMPLE 26

| | |
|---|---|
| Cobalt sulfamate (45% aqueous solution) | 361.9 cc/l |
| Ferrous borofluoride | 20 cc/l |
| Ferrous chloride | 10.11 g/l |

EXAMPLE 27

| | |
|---|---|
| Cobalt sulfamate (45% aqueous solution) | 361.9 cc/l |
| Ferrous borofluoride | 20 cc/l |
| Ferric sulfate | 17.26 g/l |

EXAMPLE 28

| | |
|---|---|
| Cobalt sulfamate (45% aqueous solution) | 361.9 cc/l |
| Ferrous borofluoride (45% aqueous solution) | 20 cc/l |
| Ferrous sulfamate (12% aqueous solution) | 28.9 cc/l |

EXAMPLE 29

| | |
|---|---|
| Cobalt chloride | 175.1 g/l |
| Ammonium borofluoride | 5 g/l |
| Ferrous chloride | 26.49 g/l |

EXAMPLE 30

| | |
|---|---|
| Cobalt chloride | 175.1 g/l |
| Sodium borofluoride | 5 g/l |
| Ferrous chloride | 26.49 g/l |

EXAMPLE 31

| | |
|---|---|
| Cobalt sulfate | 175.1 g/l |
| Ammonium fluoride | 5 g/l |
| Ferrous chloride | 26.49 g/l |

EXAMPLE 32

| | |
|---|---|
| Cobalt sulfate | 175.1 g/l |
| Sodium silicofluoride | 5 g/l |
| Ferrous chloride | 26.49 g/l |

EXAMPLE 33

| | |
|---|---|
| Cobalt sulfate | 175.1 g/l |
| Acidic sodium hydrogen fluoride | 5 g/l |
| Ferrous chloride | 26.49 g/l |

EXAMPLE 34

| | |
|---|---|
| Cobalt sulfate | 175.1 g/l |
| Ammonium fluoride | 5 g/l |
| Ferrous sulfate | 26.49 g/l |

EXAMPLE 35

| | |
|---|---|
| Cobalt sulfate | 175.1 g/l |
| Sodium silicofluoride | 5 g/l |
| Ferrous chloride | 26.49 g/l |

EXAMPLE 36

| | |
|---|---|
| Cobalt sulfamate | 175.1 g/l |
| Acidic sodium hydrogen fluoride | 5 g/l |
| Ferrous chloride | 26.49 g/l |

EXAMPLE 37

| | |
|---|---|
| Cobalt sulfamate | 175.1 g/l |
| Ammonium fluoride | 5 g/l |
| Ferrous sulfamate | 26.49 g/l |

The above effects of the present invention will be explained below with respect to the following two points.

The plating method of the present invention can completely solve the drawbacks caused by the conventional various plating methods. That is, by using the fluoride, borofluoride, silicofluoride or acidic fluoride, the plating temperature (bath temperature) can be reduced to a comparatively low temperature of less than 50° C. As a result, the stability of the plating bath is considerably improved and the formation of electrodeposition strain becomes less. In other words, when the plating is carried out in the conventional plating bath at a temperature below 80° C., the formation of electrodeposition strain becomes large and cracks are formed in the plated film of the iron-cobalt alloy, so that it is very difficult to produce the plated film having a thick thickness. While, according to the present invention, the iron-cobalt alloy having a low electrodeposition strain can be plated at a temperature of less than 50° C. by using a plating bath composed of fluoride, borofluoride, silicofluoride or acidic fluoride alone or a plating bath mixing the fluoride, borofluoride, silicofluoride or acidic fluoride with at least one of chloride, sulfate and sulfamate. Further, the plated film of iron-cobalt alloy having a thickness of more than 0.1 mm can be obtained without causing cracks and there is no precipitation of iron hydroxide.

In order to prove the above fact, the following experiment was made.

| Method A (Prior art) | |
|---|---|
| Plating bath: | |
| Cobalt chloride | 200 g/l |
| Ferrous chloride | 15 g/l |
| Plating conditions: | |
| Temperature | 50° C. |
| Current density | 5 A/dm$^2$ |
| Plating rate | 0.8 μ/min(average) |
| Substrate | stainless steel |

| Method B (Present invention) | |
|---|---|
| Plating bath: | |
| Cobalt chloride | 175.1 g/l |
| Sodium fluoride | 5 g/l |
| Ferrous chloride | 26.49 g/l |
| Plating conditions: | |
| Temperature | 50° C. |
| Current density (cathode) | 5 A/dm$^2$ |
| Plating rate | 0.933 μ/min(average) |
| Agitation | none |
| Substrate | stainless steel |

The plated film obtained by the method A had a large number of cracks, while the plated film obtained by the method B had no cracks and its properties were excellent.

Further, in order to prove that the properties of the plated iron-cobalt alloy according to the present invention are excellent, the following experiment was made.

Figure 7:
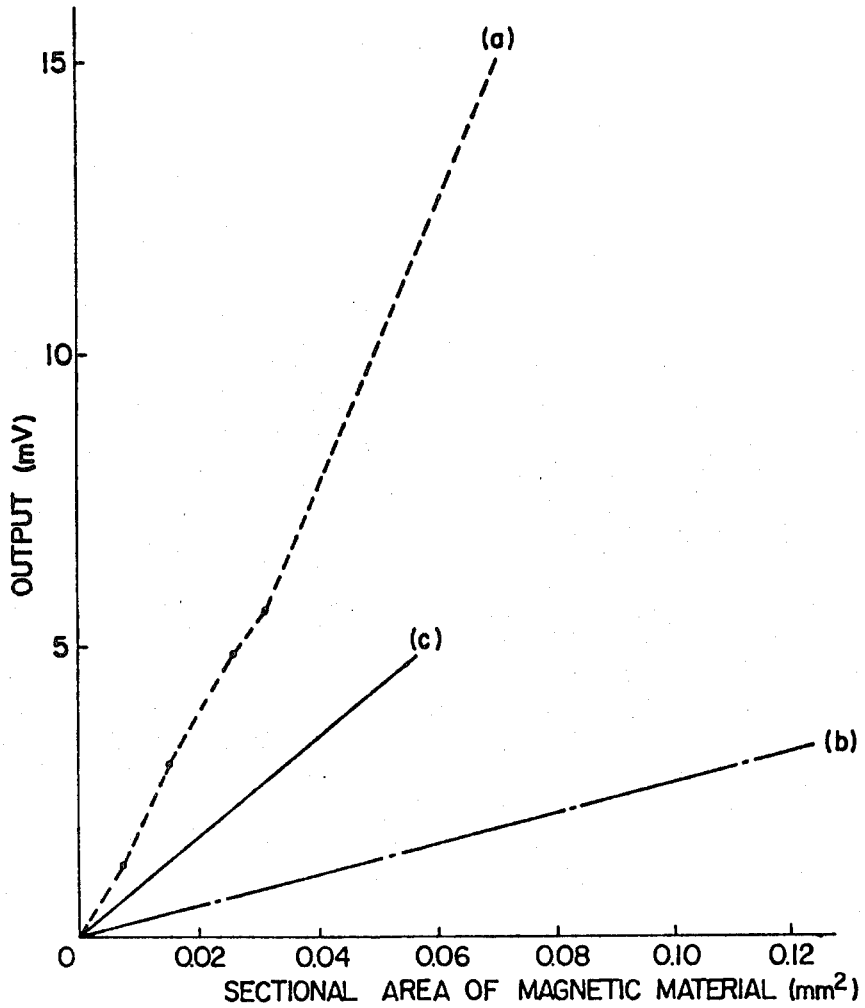
FIG. 7 is a graph showing the output voltages of the Fe-Co alloy as a magnetic material according to the present invention and the conventional magnetic materials.

Test specimens:

a: ribbon wire made from the plated foil of the iron-cobalt alloy of Example 2 b: ribbon wire of phosphor bronze electrodeposited with nickel c: commercially available ribbon wire of 2% V-Fe-Co alloy Test method:

Lead wires of 0.2ϕ diameter were wound in 30 turns on both ends of each of the specimens a, b and c, respectively. Then, a pulsating current of 40 A was instantaneously applied to one of lead wires and at the same time output corresponding to magnetostriction signal was measured at the other lead wire. The obtained results are shown in FIG. 7. In this figure, the abscissa is the sectional area (mm) of the specimen and the ordinate is the output voltage (mV). Further, the curve a shows a result of the specimen a, the curve b shows a result of the specimen b, and the curve c shows a result of the specimen c.

As seen from the curves of FIG. 7, the plated iron-cobalt alloy according to the present invention is superior as a magnetostriction material to the conventional materials.

Moreover, in order to clarify the relationship between the composition and output voltage of the plated iron-cobalt alloy film according to the present invention, the output voltage was measured in the same manner as described above with respect to the test specimens obtained by plating the iron-cobalt alloy having the following iron content and a thickness of 18.4μ on a surface of phosphor bronze ribbon wire (0.1 mm thickness×0.3 mm width×70 mm length).

| |
|---|
| Fe content 15% — output 2.8 mV |
| Fe content 25% — output 3.8 mV |
| Fe content 35% — output 3.2 mV |

Similar experiment was made by varying the iron content of Fe-Co alloy within a range of 5–60% and as a result, it has been confirmed that the expected results can be obtained by selecting the iron content within a range of 7.5–55% in view of the relation between the composition of Fe-Co alloy and the output voltage.

Moreover, the iron-cobalt alloy according to the present invention can be used as it is directly or indirectly plated on a conductor or non-conductor or may be used in a peeled-off state. Further, the properties of the plated alloy can be considerably improved by subjecting to the heat treatment. Next, the heat treatment of the iron-cobalt alloy will be further described in detail with reference to the following examples.

COMPARATIVE EXAMPLE

The iron-cobalt alloy was prepared by varying the cobalt content according to the conventional melting process. The magnetostriction (λ) of the thus obtained Fe-Co alloy was measured in various magnetic field intensities to obtain results shown in FIG. 8. In this figure, curves a, b, c and d show magnetostriction values at magnetic field intensities of 60, 150, 600 and 1100.Oe as measured by a strain gauge.

Figure 8:
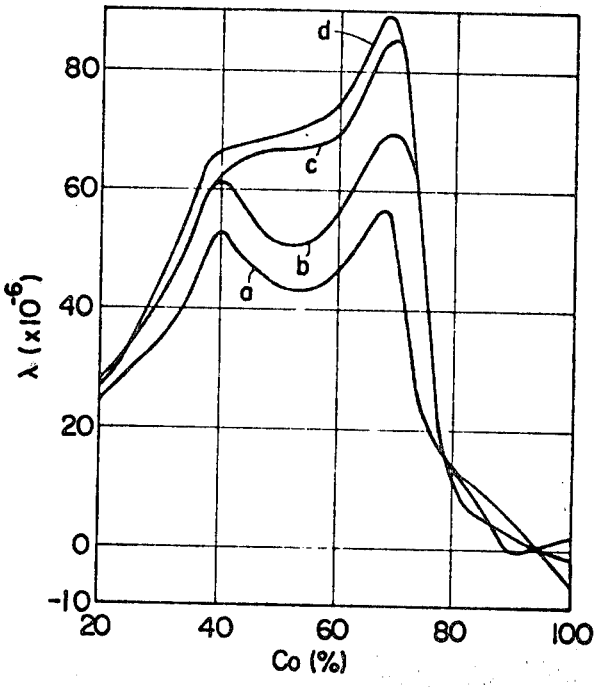
FIG. 8 is a graph showing a relation between the cobalt content and the magnetostriction of the Fe-Co alloy obtained by the conventional melting process.

From the data of FIG. 8, it can be seen that the magnetostriction rapidly lowers the cobalt content of the Fe-Co alloy increases beyond 70% independently of the magnetic field intensity. Namely, it can be said that the conventional Fe-Co alloy is poor in the magnetostriction property with the higher cobalt content.

Figure 9:
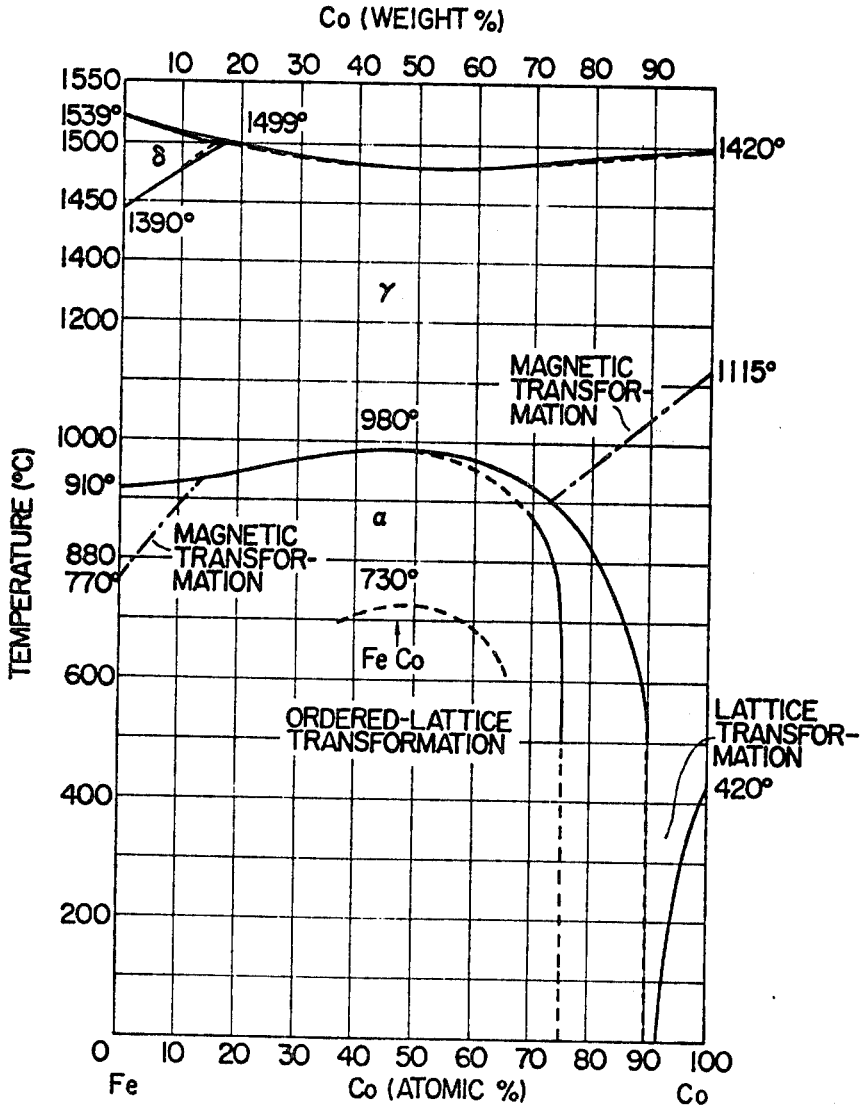
FIG. 9 is a constitutional diagram of the Fe-Co alloy shown in FIG. 8.

As seen from the constitutional diagram of this Fe-Co alloy shown in FIG. 9, when the Co content is less than 75%, α-structure (boty-centered cubic) is formed, while when the Co content is within a range of 75–92%, α+γ-structure (face-centered cubic) is formed.

Figure 12:
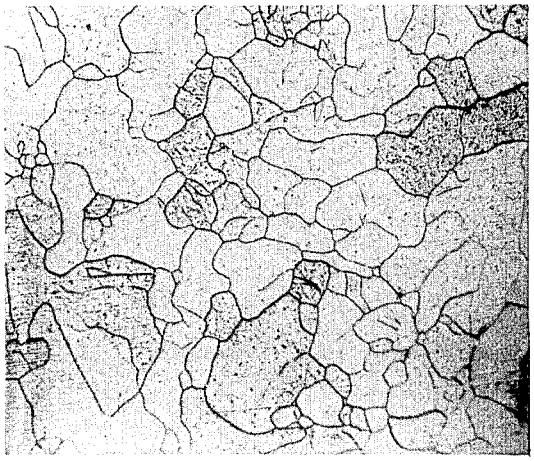
FIG. 12 is a photomicrograph showing a structure of the 30% Fe-Co alloy obtained by the conventional melting process.
Figure 13:
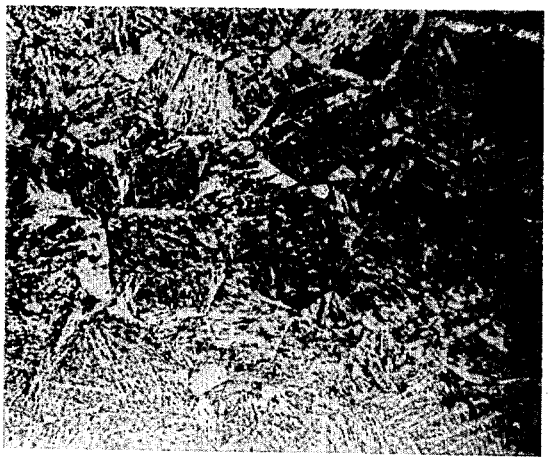
FIG. 13 is a photomicrograph showing a structure of the 20% Fe-Co alloy obtained by the conventional melting process.

The structure of the Fe-Co alloy obtained by the conventional melting process is shown in FIGS. 12 and 13 as photomicrographs (magnification: 200 times). FIG. 12 shows the 30% Fe-70% Co alloy and FIG. 13 shows the 20% Fe-80% Co alloy.

EXAMPLE 38

| | |
|---|---|
| Plating bath: | |
| Cobalt chloride | 175.1 g/l |
| Ferrous borofluoride (45% aqueous solution) | 20 cc/l |
| Ferrous chloride | 10.11 g/l |
| Plating conditions: | |
| Temperature | 50 ° C. |
| Current density (cathode) | 5 A/dm$^2$ |
| Agitation | none |

-continued

| | |
|---|---|
| Substrate | stainless steel plate |

An iron-cobalt alloy was plated on the substrate in the above plating bath under the above conditions to obtain a plated alloy film consisting of 15.16% of iron and 84.84% of cobalt and having a thickness of 30 μm. Then, the thus obtained alloy film was peeled off from the substrate. This alloy film had excellent magnetic properties and exhibited a column-like structure as shown by the photomicrograph (magnification 600 times) of FIG. 14 different from FIGS. 12 and 13.

In order to improve the magnetic properties, the alloy film was subjected to a heat treatment under the following conditions.

| | |
|---|---|
| Heating temperature | 300° C., 400° C., 500° C., 600° C., 800° C. |
| Heating time | 2 hours |
| Atmosphere during heating | vacuum, air |
| Cooling process | air-cooling, furnace-cooling, natural-cooling |

The heating was carried out in such a state that the film is sandwiched between two flat iron plates having a suitable area.

Figure 10:
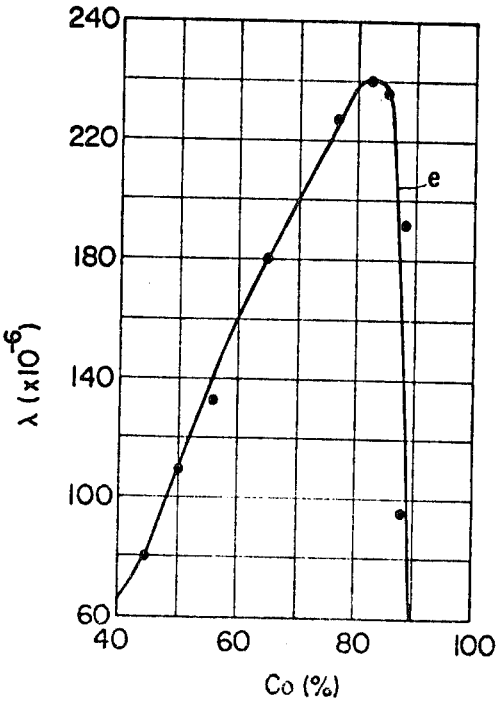
FIG. 10 is a graph showing a relation between the cobalt content and the magnetostriction of the Fe-Co alloy according to the present invention.

The magnetostriction of the heat-treated Fe-Co alloy was measured at a magnetic field intensity of 1000 (Oe) to obtain a result as shown in FIG. 10. In this figure, an abscissa shows the Co content of the alloy. As seen from FIG. 10, the maximum magnetostriction was $230\times10^{-6}$ and exhibited the magnetostriction effect of 2.5 times higher than that of the conventional alloy shown in FIG. 8.

Figure 15:
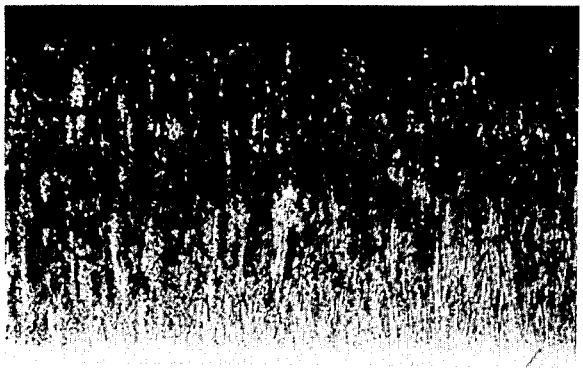
FIGS. 15–17 are photomicrographs showing structures of the Fe-Co alloy shown in FIG. 14 after heat treated at 500° C., 600° C., and 800° C. under vacuum for 2 hours, respectively.
Figure 16:
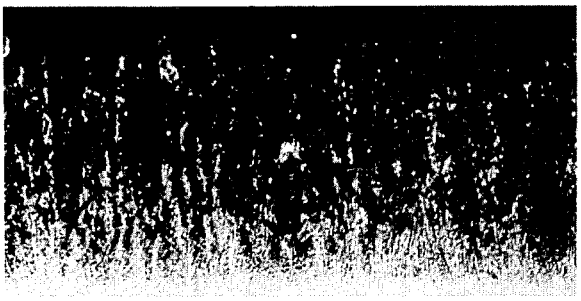
Figure 17:
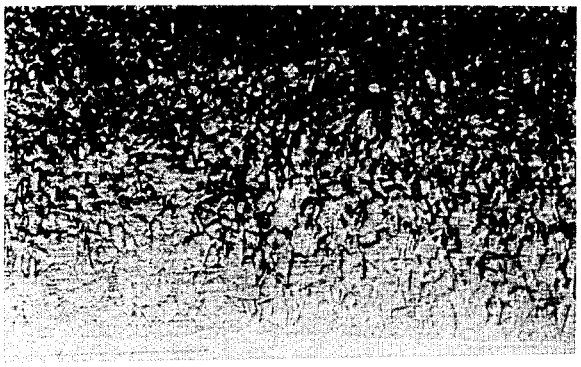

FIGS. 15–17 are photomicrographs (magnification 600 times) of the alloy after the above mentioned heat treatment, respectively. FIG. 15 shows the structure of the Fe-Co alloy after heated at 500° C. under vacuum for 2 hours, FIG. 16 shows the structure of the Fe-Co alloy after heated at 600° C. under vacuum for 2 hours, and FIG. 17 shows the structure of the Fe-Co alloy after heated at 800° C. under vacuum for 2 hours.

Figure 14:
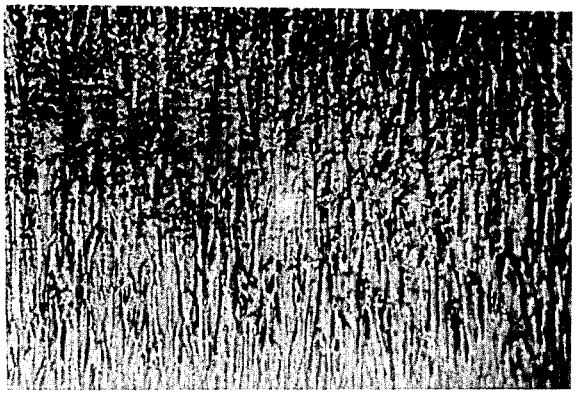
FIG. 14 is a photomicrograph showing a structure of the 16% Fe-Co alloy according to the present invention prior to the heat treatment.

As seen from FIGS. 14–15, the Fe-Co alloys had the column-like structure when the heating temperature was 300° C., 500° C. and 600° C., respectively. Furthermore, as seen from FIG. 17, the recrystallization of the structure was caused at the temperature of 800° C.

Figure 11:
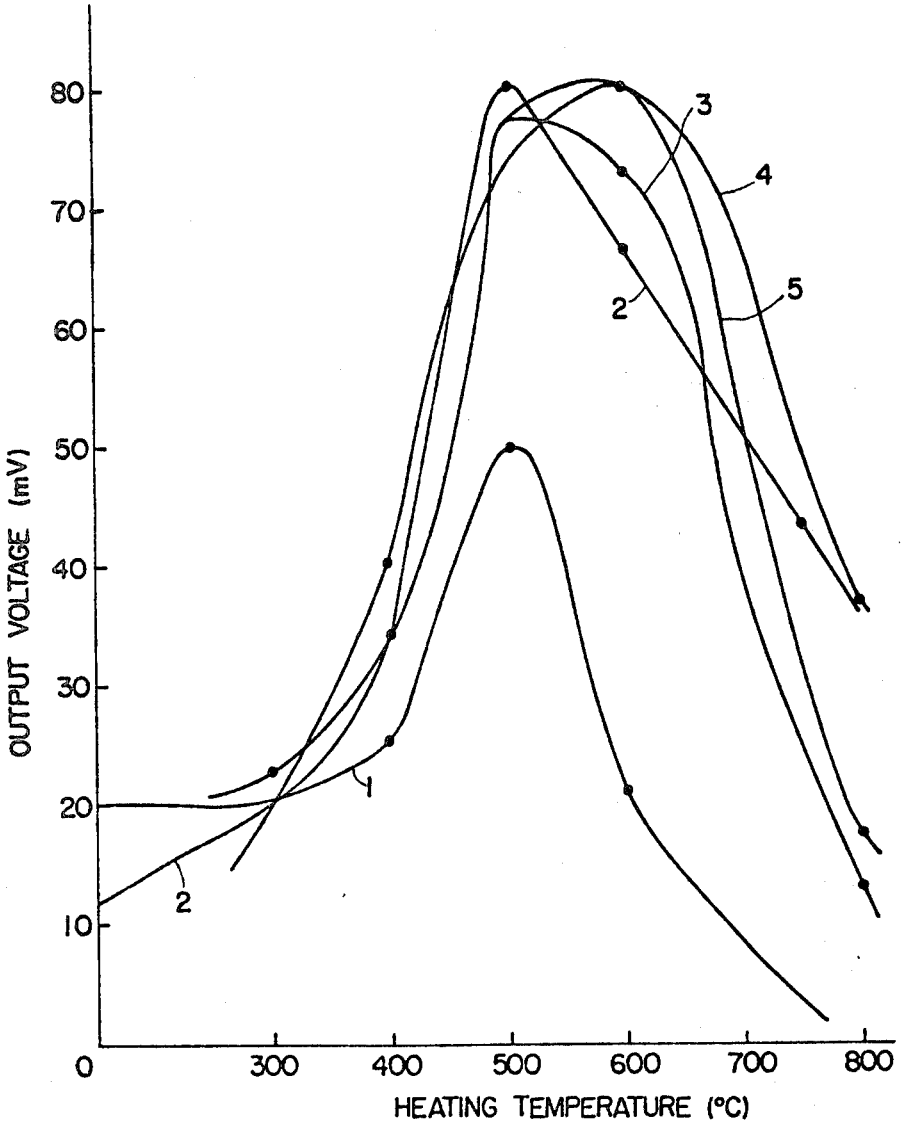
FIG. 11 is a graph showing a relation between the heating temperature and the output voltage of the Fe-Co alloy according to the present invention.

Then, the specimens having the following alloy compositions according to the present invention were measured with respect to the voltage of output signal to obtain results shown in FIG. 11. In this figure, an abscissa shows the heating temperature and an ordinate shows the value of output voltage.

Specimen 1: Fe=15.76%, Co=84.24%
Specimen 2: Fe=20.78%, Co=79.22%
Specimen 3: Fe=26.85%, Co=73.15%
Specimen 4: Fe=31.45%, Co=68.55%
Specimen 5: Fe=37.95%, Co=62.05%

The measurement of output voltage was carried out by winding a wire of 0.2ϕ diameter around each specimen at the number of turns of 20 and then applying an exciting current with 180 V and 10 A to the wire to measure the value of output voltage with a detecting coil composed of winding wire having a diameter of 10ϕ and a number of turns of 5.

The following facts will be lead from the results of FIGS. 10–17:

(1) The Fe-Co alloy having a column-like structure exhibits a high magnetostriction.

(2) By subjecting to the heat treatment at a temperature of 400°–750° C., the Fe-Co alloy having high magnetostriction and high output voltage can be obtained.

When the heating temperature approaches to 800° C., the column-like structure is changed to cause recrystallization and the internal stress itself decreases rapidly. However, properties required for the magnetostriction material, such as resiliency and the like are considerably deteriorated and the decrease of output voltage becomes conspicuous as seen from FIG. 11. For this reason, the heating temperature should be within a range of 400°–750° C. and also it is necessary not to cause the recrystallization of the structure during the heat treatment.

According to the present invention, the heat treatment may be effected by putting the alloy film in suitable spiral or coil form into a furnace. Futher, it is desirable to conduct a treatment for preventing the wrinkling of the alloy film prior to the heat treatment. Such wrinkling phenomenon may be caused even at the cooling step, so that it is preferable that the alloy film after heated for a given time is cooled up to about 400° C. without quenching, maintained at this temperature for a certain time and thereafter recooled to room temperature. Futhermore, the Fe-Co alloy film deposited on the substrate may be subjected to the heat treatment. In this case, the alloy film is peeled off from the substrate after the heat treatment.

The Fe-Co alloys according to the present invention have high magnetostriction, very high output voltage, and good workability so that they are preferably used as a material for the manufacture of various delay elements, delay memory, delay circuit, strain gauge, coordinate reading device, coordinate expansion device and the like.

What is claimed is:

1. In a method of electroplating an iron-cobalt alloy on a substrate wherein the iron-cobalt alloy consists of 7.5–55% by weight of iron and 92.5–45% by weight of cobalt and is deposited on the substrate in a plating bath by applying an electrolytic current of a modulated current thereto, the improvement which comprises using, as the plating bath, an aqueous bath containing 0.5–200 g/l of any one of fluoride, borofluoride, silicofluoride and acidic fluoride and having a pH of 0.4–4.0.

2. A method as claimed in claim 1, wherein said aqueous bath further contains at least one of chloride, sulfate and sulfamate within the pH range of 0.4–4.0.

3. A method as claimed in claim 1, wherein said fluoride is selected from hydrofluoric acid, sodium fluoride, calcium fluoride, potassium fluoride, ammonium fluoride, cobalt fluoride and ferrous fluoride.

4. A method as claimed in claim 1, wherein said borofluoride is selected from cobalt borofluoride, ferrous borofluoride, sodium borofluoride, potassium borofluoride, calcium borofluoride and ammonium borofluoride.

5. A method as claimed in claim 1, wherein said silicofluoride is selected from sodium silicofluoride, potassium silicofluoride, calcium silicofluoride and ammonium silicofluoride.

6. A method as claimed in claim 1, wherein said acidic fluoride is selected from acidic sodium hydrogen fluoride, acidic potassium hydrogen fluoride, acidic calcium hydrogen fluoride and acidic ammonium hydrogen fluoride.

7. A method as claimed in claim 1, wherein said plating is carried out at a temperature of not more than 50° C.

8. A method as claimed in claim 1, wherein said plating is carried out by using an iron plate and a cobalt plate as anodes and applying the electrolytic current to each plate while considering their anodic current efficiencies, whereby these plates are dissolved to supplement iron and cobalt ion concentrations in the plating bath.

9. A method as claimed in claim 8, wherein said plating is carried out by correcting the change of total metal ion concentration in the plating bath due to the difference between the anodic current efficiency and the cathodic current efficiency by preliminary electrolysis.

* * * * *